US007812486B2

(12) United States Patent
Pfannschmidt

(10) Patent No.: US 7,812,486 B2
(45) Date of Patent: Oct. 12, 2010

(54) DIRECT ELECTRICAL DRIVE

(75) Inventor: Bernd Pfannschmidt, Rosstal (DE)

(73) Assignee: Siemens Aktiengesellschaft, München (DE)

( * ) Notice: Subject to any disclaimer, the term of this patent is extended or adjusted under 35 U.S.C. 154(b) by 625 days.

(21) Appl. No.: 10/595,250

(22) PCT Filed: Sep. 29, 2004

(86) PCT No.: PCT/EP2004/010901

§ 371 (c)(1),
(2), (4) Date: Dec. 5, 2006

(87) PCT Pub. No.: WO2005/032902

PCT Pub. Date: Apr. 14, 2005

(65) Prior Publication Data

US 2007/0120428 A1 May 31, 2007

(30) Foreign Application Priority Data

Sep. 30, 2003 (DE) ..... 103 45 888 U

(51) Int. Cl.
*H02K 1/32* (2006.01)
*H02K 9/00* (2006.01)

(52) U.S. Cl. ..... 310/61; 310/52; 310/58; 310/59

(58) Field of Classification Search ..... 310/61, 310/52, 58, 59; 180/65.5
See application file for complete search history.

(56) References Cited

U.S. PATENT DOCUMENTS 1,238,292 A * 8/1917 Hellmund ..... 310/61
2,846,600 A * 8/1958 Potter ..... 310/61
2,991,377 A * 7/1961 Vose et al. ..... 310/61
3,701,911 A * 10/1972 Hallerback ..... 310/60 R
3,846,651 A * 11/1974 Mishra ..... 310/61
3,906,265 A * 9/1975 Giles ..... 310/55
4,383,191 A * 5/1983 Mizuyama et al. ..... 310/59
4,682,064 A * 7/1987 Crounse et al. ..... 310/61
5,757,094 A * 5/1998 van Duyn ..... 310/58
6,359,350 B1 * 3/2002 Kaiho et al. ..... 310/52
6,426,574 B1 * 7/2002 Hess et al. ..... 310/61

FOREIGN PATENT DOCUMENTS

DE 31577 5/1885
DE 25 01 134 A 7/1975
DE 4427760 A1 * 2/1996
DE 196 48 455 A1 10/1997
DE 100 47 911 A 4/2002
DE 101 22 425 A 11/2002
JP 11 255118 A 9/1999

* cited by examiner

*Primary Examiner*—Quyen Leung
*Assistant Examiner*—Alex W Mok
(74) *Attorney, Agent, or Firm*—Henry M. Feiereisen; Ursula B. Day

(57) ABSTRACT

The invention relates to a direct electrical drive (1) for a wheel set (30) of a vehicle, wherein the direct electrical drive (1) comprises a stator (7) and a rotor (3), with the rotor (3) being coupled mechanically with a wheel set shaft (11). The rotor (3) includes a cooling device. The cooling device includes cooling channels (22), an air inlet (37) and at least one fan (9), whereby the cooling channels (22) extend inside the rotor (3).

13 Claims, 1 Drawing Sheet

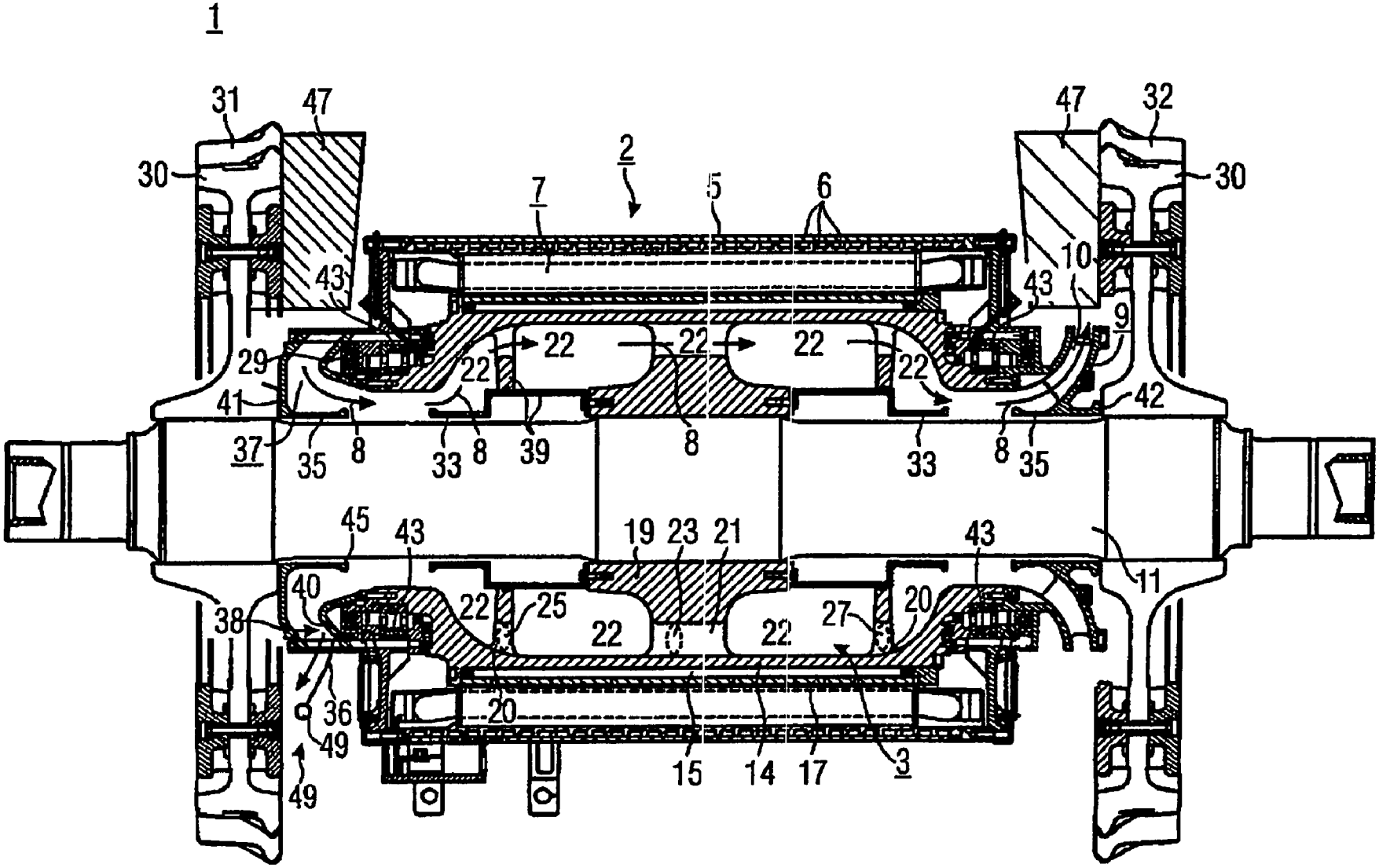
1
2
3
5
6
7
8
9
10
11
14
15
17
19
20
21
22
23
25
27
29
30
31
32
33
35
36
37
38
39
40
41
42
43
45
47
49

DIRECT ELECTRICAL DRIVE

BACKGROUND OF THE INVENTION

The invention relates to a direct electrical drive for a wheel set of a vehicle. The vehicle is in particular a rail vehicle such as for example a train, a motor car, a locomotive, or a streetcar. The Offenlegungsschrift DE 100 47 911 A1 discloses a drive for a wheel set of a vehicle, having two wheels disposed on a wheel set shaft. The wheels can be driven by at least one internal rotor motor which encompasses the wheel set shaft. The internal rotor motor includes a stator and a rotor. The tubular rotor has permanent magnets on its surface. When using the direct electrical drive for rail vehicles for example, damage to the wheel set shaft during operation cannot be excluded.

Direct electrical drives have an electric motor constructed in particular as a synchronous motor or asynchronous motor. Despite their good efficiency, the rotor of synchronous motors as well as asynchronous motors encounters losses. As the rotor increasingly heats up, the efficiency of the electrical machine, like for example of the synchronous motor or asynchronous motor, declines.

SUMMARY OF THE INVENTION

It is an object of the present invention to improve a direct electrical drive. The improvement relates in particular to the cooling of the direct electrical drive and protection of a wheel set shaft of the direct electrical drive from damage.

This object is attained by a direct electrical drive having the features set forth in claim 1. The sub-claims 2 to 10 relate inventive developments of the direct electrical drive.

In accordance with the invention, a direct electrical drive of a wheel set of a vehicle includes a stator and a rotor, with the rotor being coupled mechanically to a wheel set shaft. At least the rotor includes hereby a cooling device. With the aid of the cooling device, the rotor can be cooled. Through cooling the rotor, the performance of the direct electrical drive can be improved. Losses in the rotor can be removed by means of the cooling device so that a best possible utilization of the direct electrical drive becomes possible. The utilization relates to an electric machine, with the electric machine being part of a direct electrical drive which includes at least also a wheel set shaft in addition to the electric machine having the stator and the rotor.

The cooling device includes in particular cooling channels, an air inlet, and at least one fan. The cooling channels extend advantageously within the rotor. The fan can be used as ventilator for the rotor wherein this fan is advantageously useable also for cooling the stator. The fan is in particular a suction fan or also a pressure fan. When constructed as suction fan, the fan forms in particular also an air outlet of the cooling device.

Advantageously, the wheel set shaft is completely enveloped between wheels of the wheel set by means of the electric machine of the direct electrical drive. The enveloping configuration results in a protection of the wheel set shaft against damage. Damage may be caused in rail vehicles during travel by upwardly hurled ballast or also upwardly sucked dirt.

According to an advantageous configuration, the direct electrical drive and/or the cooling device includes at least a means for protection of the wheel set shaft.

When for example the direct electrical drive is mounted as motive drive for a rail vehicle directly onto a wheel set shaft, remaining open areas of the wheel set shaft can be protected from damage by the direct electrical drive or the electric machine of the direct electrical drive. Dirt penetrating the area of the wheel set shaft can hereby be carried back or so deposited that damage adversely affecting operation of the wheel set shaft does not occur or is reduced.

According to an advantageous configuration, the rotor has a least one rotor hub. The rotor hub is coupled mechanically to the wheel set shaft, with the rotor hub being connected via at least one rotor web with a support for a rotor reaction part. The support for a rotor reaction part is provided as receptacle for a rotor reaction part. The rotor reaction part has permanent magnets for example. The provision of webs within the rotor allows configuration of cooling channels. The webs are designed such that an axial channel can be configured for guiding the cooling air. A fan is mounted for example to an axial end of the fan and revolves at the rotation speed of the wheel set. By means of the fan, air can be drawn in through an opening at the other axial end of the rotor. This air is tailored to flow to the inner walls of the support of the rotor reaction part by an air guide device inside the rotor. Entry of air into the rotor is obtained for example by a fixed air inlet that does not move jointly with the rotor.

According to further embodiments, the air inlet may also be configured such as to move jointly with the rotor. Advantageously, the direct electrical drive has at least one wheel disk closure, whereby advantageously both wheels of the wheel set have a wheel disk closure. The wheel disk closure is so configured as to turn in synchronism with the wheel. As a consequence, the wheel disk closure and the wheel (wheel disk) are not subjected to wear. This is especially advantageous when the wheel cannot move in symmetry or in synchronism to the rotor. This is the case for example when the wheel set shaft is subjected to bending stress and slightly sags. If this is not to be expected, the wheel disk closure can be coupled also to the rotor. The wheel disk closure can be configured as a separate part, or part of the cooling device, or part of a housing of the direct electrical drive, or part of a housing of the electric machine.

According to a further embodiment of the direct electrical drive, the fan is secured on the wheel set shaft. This provides enhanced protection of the wheel set shaft in the area of attachment.

According to an advantageous embodiment, the fan or the air inlet is part of a bearing seal. This allows a better protection of the bearings of the direct electrical drive. The rotor can be rotatably moved in relation to the stator by means of the bearings.

As already described, the protection of the wheel set shaft in particular from penetrating dirt or damage can be improved in the direct electrical drive according to the invention. This can be attained in particular by configuring the fan at the axial end of the rotor and the air inlet on the axial end such as to be disposed in closest possible proximity to the wheel disks of the wheels of the wheel set. As a result, the wheel set shaft is completely enveloped between the wheels of the wheel set and better protected against damage.

According to a further advantageous embodiment, the means for protection of the wheel set shaft is realized by a catch device, with the catch device being in particular part of the fan or part of the air inlet. The catch device is configured for example in the form of a catch channel inside the direct electrical drive, wherein entering coarse dirt can be collected by means of the catch device. Advantageously, the catch device is so configured that entering coarse dirt or foreign bodies can be guided to the outside, i.e. outside the direct electrical drive or outside the electric machine.

Arrangement of further guide devices in the interior of the rotor for example further ensures that dirt or foreign bodies still migrating into the interior is prevented from continuously dropping back onto the wheel set shaft while the latter is moved. Foreign bodies or dirt remains inside of the direct electrical drive such that the wheel set shaft is not inadmissibly being damaged. Such foreign bodies or dirt remaining inside of the direct electrical drive can be expelled during subsequent cleaning.

Advantageously, the inside walls of the rotor, in particular inside walls of the support for the rotor reaction part or also walls of the cooling air channels, are provided with a dirt-binding surface. Examples of dirt-binding surfaces are rough surfaces or also sticky surfaces. As a result of such a dirt-binding surface, dirt or also foreign bodies can adhere to a surface in such a manner that dirt or foreign bodies can no longer freely move inside the direct electrical drive. A free mobility may cause damage to the wheel set shaft or also to the rotor. When the dirt-binding surface rotates and has a surface normal in axial direction, the centrifugal force assists advantageously the motion-inhibiting effect of the dirt-binding surface.

The invention enables construction of a rotor cooling for a rotor of an electric machine of a direct electrical drive for a wheel set shaft, which rotor cooling in addition to cooling provides at the same time a protection of the wheel set shaft. Advantageously, the cooling device for the rotor has also components which are part of the bearing seal.

According to a further advantageous configuration, the means of protection of the wheel set shaft is a dirt guiding device. By means of the dirt guiding device, dirt can be routed into certain regions inside the direct electrical drive, whereby these regions may also form deposit regions for dirt or also foreign bodies.

According to a further advantageous configuration, the air inlet has a baffle wall. By means of a baffle wall having a certain inclination in relation to the penetrating foreign bodies to be expected, foreign bodies which may penetrate to the inside of the direct electrical drive, can be deflected. The baffle wall is thus configured such that foreign bodies migrating into the air inlet can bounce out again by this baffle plate out of the opening of the air inlet.

For protection, the wheel set shaft has a continuous jacket between the wheels of the wheel set. This jacket can be realized, as already described above, by a plurality of components of the direct electrical drive for example. Examples of these components include the electric machine, the cooling device, or also wheel disk closures.

BRIEF DESCRIPTION OF THE DRAWING

The invention will now be described by way of example with reference to an example shown in the FIGURE which is a sectional view of a direct electrical drive according to the invention.

DETAILED DESCRIPTION OF PREFERRED EMBODIMENTS

The illustration according to FIG. 1 shows a direct electrical drive 1. The direct electrical drive 1 has an electric machine 2. The electric machine 2 in turn has a stator 7 and a rotor 3. Cooling of the stator 7 is realized by a cooling jacket 5 having stator cooling channels 6. In addition to the electric machine 2, the direct electrical drive has a wheel set shaft 11. The wheel set shaft is coupled mechanically with the rotor 3 of the electric machine. The mechanical linkage is implemented for example by shrinking the rotor 3 onto the wheel set shaft 11. The rotor 3 has at least one, advantageously several cooling channels 22. The cooling channel 22 is configured by providing openings 23, 25 and 27 in the rotor 3, with the rotor 3 having webs 20 and 21. The openings 23 and 27 are formed by means of the webs 20. The opening 23 is configured by means of the rotor web 21. The rotor web 21 leads to as rotor hub 19. The rotor hub 19 is coupled mechanically directly to the wheel set shaft 11. The rotor hub 19 is connected via rotor webs 20, 21 to a support 14 for a rotor reaction part 15. The rotor reaction part 15 has permanent magnets for example. The rotor reaction part 15 is protected in relation to the stator 7 by a protective part 17.

The wheel set shaft 11 is connected to a wheel set 30, with the wheel set 30 having wheels 31 and 32. The wheels, 31, 32 can be decelerated by means of a brake 47 indicated schematically. The rotor 3 is movable in relation to the stator 7 by means of bearings 43. The bearings 43 have a bearing seal 29. The rotor 3 can be cooled by means of a fan 9. The fan 9 has fan blades 10 for generating an air flow. As suction fan, the fan 9, which is coupled to the rotor 3 as a self-ventilating internal fan, draws in cooling air through an air inlet 37 as the rotor 3 is caused to rotate. The air inlet 37 is configured as nozzle for example. Cooling air depicted by way of arrow 8 flows through the cooling channel 22. The air inlet 37 has an air inlet opening 36. Detrimental dirt particles, rocks, other foreign bodies (49) or the like for example, which are hurled upwards from the bottom in the direction of the air inlet 36 in particular during travel, can migrate via this air inlet opening 36 into the electric machine 2. Such bodies are prevented by various measures from damaging the wheel set shaft 11 or prevented from reaching the electric machine 2. One means for preventing damage to the wheel set shaft 11 is the inclination of the air inlet 37. The inclination 38 is configured such that foreign bodies can be bounced back by a baffle wall 40. In the event a foreign body 49 may still migrate further into the air inlet 37, the foreign body 49 is prevented by a catch device 35 from impacting the wheel set shaft 11. The catch device 35 forms a type of channel, whereby the catch device 35 has advantageously a nose 45. The nose 45 is provided to allow deflection of a foreign body 49 by this nose 45 back to the air inlet opening 36 so that the foreign body 49 is able to leave again the area of the air inlet 37 through the air inlet opening 36. The air inlet 37 has advantageously a wheel disk closure 41. The wheel disk closure 41 rests upon the wheel 31 or rests at least closely thereto so that such foreign particles that may cause damage to the wheel set shaft 11 can be kept away from this wheel set shaft 11. Advantageously, the fan 9 too has a wheel disk closure 42. Like the wheel disk closure 41, the wheel disk closure 42 provides protection of the wheel set shaft 11.

The cooling channel 22 has for example at least one air guiding device 39. The air guiding device 39 provides advantageously a guidance of the cooling air. The air guiding device can also be designed in such a manner as to provide a protection of the wheel set shaft 11. The air guiding device 39 includes for that purpose a dirt guide device 33 in particular or is configured such that a structural part is able to realize an air conduction as well as a protective action for the wheel set shaft.

What is claimed is:

1. A direct electrical drive for a wheel set of a vehicle, comprising:

a stator;

a rotor interacting with the stator and having a rotor hub coupled mechanically with a wheel set shaft of the wheel set, said wheel set shaft defining an axis;

a cooling device constructed to cool the rotor and including a fan for drawing in air through an air inlet and conducting the air through a cooling channel inside the rotor; and a barrier located in an area within the rotor in close proximity adjacent to the wheel set shaft to protect the wheel set shaft against ingress of foreign matter via the air inlet when the fan draws in air, said barrier including a catch device extending in a direction of the axis in parallel relationship to the wheel set shaft, and a dirt guide device connected to the rotor hub at a distance to and in alignment with the catch device.

2. The direct electrical drive according to claim 1, wherein stator and the rotor are part of an electric machine, wherein the wheel set has two wheels mounted to the wheel set shaft, said wheel set shaft being completely enveloped in an area between the wheels by the electric machine.

3. The direct electrical drive according to claim 2, wherein the wheel set shaft has a continuous jacket between the wheels of the wheel set.

4. The direct electrical drive according to claim 1, wherein the rotor hub is connected via at least one rotor web with a support for a rotor reaction part.

5. The direct electrical drive according to claim 1, wherein the catch device has a first section forming part of the fan and disposed in close proximity of an air outlet of the cooling channel.

6. The direct electrical drive according to claim 5, wherein the catch device has a second section in close proximity of the air inlet.

7. The direct electrical drive according to claim 6, wherein the first and second sections of the catch device have an inwardly turned nose.

8. The direct electrical drive according to claim 1, wherein the barrier includes a baffle wall disposed in the air inlet for deflecting foreign matter.

9. The direct electrical drive according to claim 8, wherein the baffle wall has a slanted configuration.

10. The direct electrical drive according to claim 1, wherein the rotor has a dirt-binding surface.

11. The direct electrical drive according to claim 10, wherein the surface is sticky.

12. The direct electrical drive according to claim 1, wherein the cooling channel has an inside wall formed with a dirt-binding surface.

13. The direct electrical drive according to claim 1, wherein the dirt guide device is part of an air guiding device of stepped configuration.

* * * * *